United States Patent [19]

Uesugi et al.

[11] Patent Number: 4,872,946

[45] Date of Patent: Oct. 10, 1989

[54] METHOD OF MANUFACTURING SUPPORTS FOR LITHOGRAPHIC PRINTING PLATE

[75] Inventors: Akio Uesugi; Tsutomu Kakei; Shinichiro Minato, all of Shizuoka, Japan

[73] Assignee: Fuji Photo Film Co., Ltd., Kanagawa, Japan

[21] Appl. No.: 159,086

[22] Filed: Feb. 23, 1988

[30] Foreign Application Priority Data

Feb. 23, 1987 [JP] Japan ..... 62-37798
Mar. 25, 1987 [JP] Japan ..... 62-69135

[51] Int. Cl.[4] ..... C23F 1/00; B44C 1/22

[52] U.S. Cl. ..... 156/637; 156/645; 156/651; 156/665; 156/905; 156/345; 204/129.1

[58] Field of Search ..... 156/637, 639, 645, 651, 156/656, 659.1, 664, 665, 905, 272.2, 345; 204/129.1, 129.35, 129.46, 129.7

[56] References Cited

U.S. PATENT DOCUMENTS

| | | | |
|---|---|---|---|
| 2,235,658 | 3/1941 | Waterman | 156/639 |
| 2,539,248 | 1/1951 | Lynch et al. | 156/639 |
| 3,730,799 | 5/1973 | Scannell | 156/639 |
| 3,753,817 | 8/1973 | Geissled et al. | 156/639 |
| 4,440,594 | 4/1984 | Stears | 156/639 X |
| 4,501,636 | 2/1985 | Valley | 156/637 X |

*Primary Examiner*—William A. Powell
*Attorney, Agent, or Firm*—Sughrue, Mion, Zinn, Macpeak and Seas

[57] ABSTRACT

The processing supports for lithographic printing plate is improved by an induction heating method while chemically and/or eldctric-chemically surface-treating the metal sheet or web to affect the surface roughness thereof.

24 Claims, 5 Drawing Sheets

METHOD OF MANUFACTURING SUPPORTS FOR LITHOGRAPHIC PRINTING PLATE

BACKGROUND OF THE INVENTION

This invention relates to a method for manufacturing supports for a lithographic printing plate.

A variety of methods for manufacturing lithographic printing plate supports have been proposed. Some methods include electro-chemical or chemical treatment, in which methods it is essential to control electrochemical or chemical reactions. For this purpose, the reaction time, liquid composition, solution temperature, and electrical condition are suitably controlled.

To accommodate a strong demand for increasing the productivity of processes for manufacturing supports for lithographic printing plate, it is necessary to decrease the treating time. For this purpose, increasing the temperature of the treating solution or increasing the longitudinal dimension of the tank in which the treating solution is contained have been attempted.

However, when the temperature of the treating solution is increased, scales form in the treating solution, with the result that the manufacturing equipment, such as the treating tank, becomes corroded. In the case where the length of the treating tank is increased, the cost of construction and the space required for the installation are significantly increased. That is, this method is disadvantageous in that the cost of equipment is high. In order to manufacture many various types of lithographic printing plates, but only a few of each type of plate, it is essential to make the time required for varying the treatment conditions as short as possible. However, in previously proposed methods, a lot of time and energy is required to increase or decrease the temperature of the treating solution.

SUMMARY OF THE INVENTION

The inventor has conducted intensive research on the above-described difficulties accompanying conventional methods for manufacturing lithographic printing plate supports, and has invented a method in which a metal sheet or web is chemically or electro-chemically treated in a treating solution while being induction-heated.

BRIEF DESCRIPTION OF THE DRAWINGS

The features, objects and advantages of the inventive method will be better understood upon reading the detailed description set forth below with reference to the drawings, in which.

DETAILED DESCRIPTION OF THE PREFERRED EMBODIMENTS OF THE INVENTION

Figure 1:
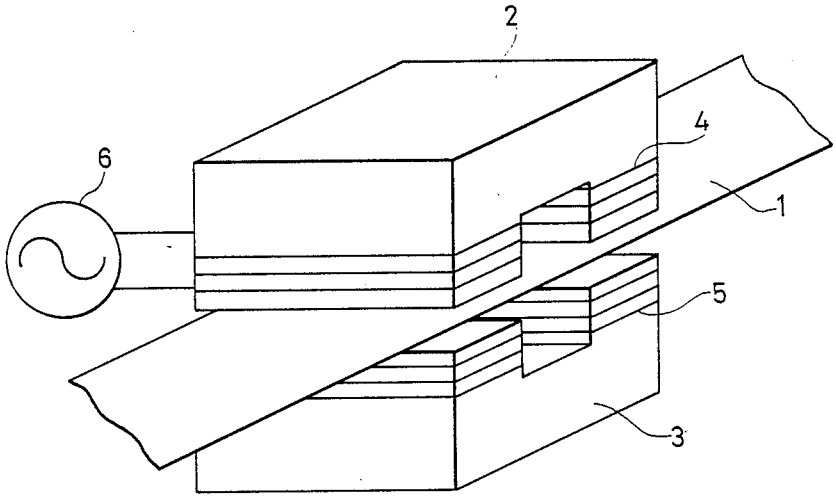
FIG. 1 is an explanatory diagram showing a conventional cross magnetic field type induction heating method.

The invention will be described hereunder in detail with reference to the accompanying drawings.

In the invention, aluminum sheet or web are predominantly employed in forming the supports for lithographic printing plate. The aluminum sheet or web are made of pure aluminum or aluminum alloy. The latter essentially contains aluminum in addition to small amounts of silicon, copper, iron, manganese, magnesium, chromium, zinc, lead, bismuth and nickel. It is preferable that the aluminum sheet or web be at least 99.0% aluminum.

The invention will be described with reference to the case where the aluminum web is subjected to mechanical, chemical and/or electro-chemical surface roughening. However, it should be noted that the invention is not limited thereto or thereby. That is, the invention is applicable to the case where the aluminum web is processed by other methods. Furthermore, the invention is applicable to other metal sheets or webs such as zinc or iron sheets or webs.

A lithographic printing plate made of the above-described aluminum sheet is, in general, shaped rectangularly so as to fit on a typical printing machine. However, in the invention, it is preferable that the aluminum sheet be processed in the form of a web, especially in the case of mass production, and the aluminum web thus processed be cut into a rectangular plate as required.

The thickness of the aluminum web is in a range of from 0.1 to 0.5 mm depending on the tensile strength, yield strength, elongation and bending strength which are required when the lithographic printing plate is set on the printing machine.

It is preferable that the aluminum web be subjected to mechanical surface-roughening before it is chemically processed or electrochemically processed according to the invention. The aluminum web surface may be roughened by mechanical polishing mechanisms such as a brush grain mechanism.

A typical example of a method for chemically processing the aluminum web is a chemical etching method using an alkaline solution such as caustic soda. Alternatively, the web may be etched with solutions (for instance, acids such as hydrofluoric acid, phosphoric acid and sulfuric acid) which erode aluminum material. Preferable alkali agents are caustic soda, caustic potash, sodium metasilicate, sodium carbonate, sodium aluminate and sodium gluconate. In the etching method, suitable etchant concentrations range from 1% by weight to 50% by weight. A suitable temperature may range from room temperature to 90 degrees. The etching period is in a range of five (5) seconds to five (5) minutes. Optimal values in these ranges depend upon the material employed.

The aluminum web, when alkali-etched, is subjected to desmutting with an acidic solution ($NHO_3$, $H_2SO_4$ or $H_2PO_4$), to remove any materials (smut) which are insoluble in the alkali solution and which have remained on the surface of the web.

One example of an electro-chemical method for processing the aluminum web is a surface roughening method.

In this method, it is preferable to use a hydrochloric acid solution, a nitric acid solution or a mixture of these two acid solutions as an electrolyte solution. The aluminum web is subjected to DC or AC electrolysis in an electrolyte solution having an electrolyte concentration of 0.1 to 10 wt %, preferably 0.3 to 3 wt % based on the total weight of electrolyte solution. The surface of the aluminum plate is roughened in proportion to the quantity of electricity used in the electrolysis. The pit depth of the surface thus roughened is in a range of 0.5 to 10 μm, preferably in a range of 1 to 4 μm, and the pit diameter is in a range of 1 to 100 μm, preferably in a range of 5 to 20 μm.

The above-described pit diameter can be preferably formed using the special alternating waveform alternative current disclosed in Japanese patent application Publication No. 19280/1981 or 19191/1980. That is, controlling the electrolytic waveform can economically and uniformly roughen the surface. Furthermore, as disclosed by the specifications of U.S. Pat. Nos. 3,963,564 and 3,980,539, an amine, gluconic acid, boric acid, phosphoric acid or hydrofluoric acid may be added to the electrolytic solution.

In the invention, the aluminum web can be subjected to the above-described electro-chemical treatment after a chemical treatment. The electrolytic solution used in the electro-chemical treatment may be the same solution as the etching solution used in the above-described chemical treatment. The surface of the aluminum web is roughened again in proportion to the quantity of electricity used for electrolysis; that is, a secondary roughened surface is formed on the aluminum web. The pitch depth of the secondary roughened surface is in a range of 0.1 to 1 μm, preferably in a range of 0.1 to 0.8 μm, and the pit diameter is in a range of 0.1 to 5 μm, preferably in a range of 0.1 to 3 μm. The formation of the secondary roughened surface is controlled by controlling the electrolytic waveform.

During these treatments, the aluminum web can be subjected to induction heating with a conventional induction heating device. That is, the quantity of current flowing in the device may be changed to adjust the temperature of the aluminum web in the etchant or electrolyte.

FIG. 1 shows a conventional cross field type induction heating device having an inductor. In this device, a static magnetic field is formed to heat a material, which is an aluminum web in this case. As an example, Japanese patent application (OPI) No. 100390/1985 discloses a three-pole static cross field type induction heating device.

It is preferable that the aluminum web on which secondary roughened surfaces have been formed is treated with an acid or alkali solution. More specifically, in this treatment, in addition to the sulfuric acid solution described in the specification of Japanese patent application Publication No. 11316/1981, phosphoric acid, or a mixture of phosphoric acid and chromic acid may be used. The aluminum web is slightly etched with an alkaline solution such as caustic soda as described in the specification of Japanese patent application Publication No. 28123/1973 so that smut is removed from the surface. As was described above, the surface of the aluminum web is etched in order to remove the smut therefrom, and therefore, insoluble components remain in the alkaline solution. Therefore, it is necessary to subject the aluminum web to desmutting with an acidic solution (sulfuric, phosphoric or chromic acids).

With a slurry solution accelerated with high-pressure water, a primary rough surface is formed on the aluminum web. Then the rough surface is deformed using the brush grain method. The aluminum web thus treated may be used as a support for lithographic printing plate. On the other hand, in order to maintain the stability of the diazo compound in the photo-sensitive layer over time, or in order to improve the adhesion to the photo-sensitive layer or the printing resistance, and anodic oxide film may be formed on the intermediate layer (defined below) or the aluminum surface.

The term "intermediate layer" as used herein is intended to mean an alkali metal silicate, such as a silicate layer formed by immersion of sodium silicate, as described in U.S. Pat. Nos. 2,714,066 and 3,181,46, or a hydrophilic undercoat such as Carboxymethyl cellulose (CMC) or Polyvinyl alcohol (PVA) undercoat.

Examples of an electrolyte suitable for the formation of the anodic oxide film are phosphoric acid, chromic acid, oxalic acid and benzene sulfonic acid.

It is desirable that the anodic oxide film formed on the surface have a surface distribution in a range of 0.1 to 10 $g/m^2$, preferably 0.3 to 5 $g/m^2$. It is preferable that the aluminum web be subjected to alkali etching and desmutting before anodic oxidation.

In anodic oxidation, the conditions depend on the electrolyte used. However, in general, the electrolyte concentration within the electrolytic solution is in a range of 1 to 80 wt % and the solution temperature ranges from 5 to 70° C., the current density is in a range of 0.5 to 60 $A/cm^3$, the voltage ranges from 1 to 100 V, and the electrolysis time ranges from ten (10) seconds to five (5) minutes.

The surface-roughened aluminum web having the anodic oxide film thus formed is sufficiently hydrophilic, and therefore a photo-sensitive layer can be formed directly on it. However, it may be subjected to additional surface treatment, when necessary. For instance, the above-described silicate layer of alkali metal silicate, or an undercoat layer of a hydrophilic macromolecular compound may be formed thereon. It is preferable that the undercoat layer have a surface distribution in a range of 5 to 150 $mg/m^2$.

Figure 2:
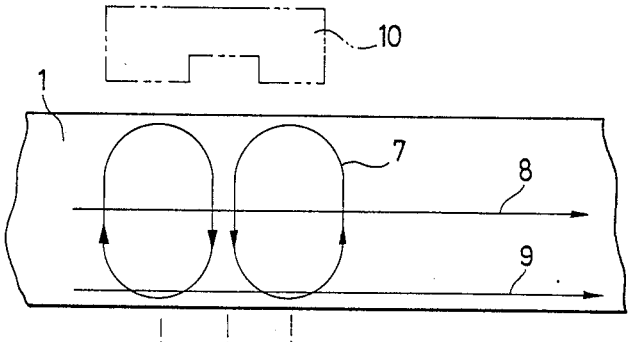
FIG. 2 is an explanatory diagram showing an induction current distribution on a metal web in the conventional method.

In the above-described conventional device employed in this invention, the magnetic field provided by the inductor is static. Therefore, the induction current generated in the metal web is static, and the Joule heat produced in the metal web by the induction current is distributed in the form of a static ring as viewed from the inductor. The distribution of the induction current is as shown in FIG. 2.

Heat is generated only at a portion of the metal web where the induction current ring is formed, and heat is radiated from the remaining portion. Therefore, when the metal web is subjected to induction heating in the treating solution, the aforementioned remaining portion is cooled by the solution. A first difficulty accompanying the conventional device is as follows: When the metal web is subjected to induction heating while being conveyed, each part of the metal web is cyclically heated and cooled depending on its position relative to the inductor, and therefore, it is very difficult to maintain the web at a constant temperature. This effect is significant in the case where the web is conveyed at low speed—such that the temperature history of the web exhibits a large difference between the high and low temperatures.

This is a serious factor in the case where induction heating is utilized during chemical treatment of the metal web. This is, the chemical reaction on the web is not carried out under constant conditions, as a result of which the surface of the web is not uniformly treated in its entirety. The resultant product is lowered in quality.

A second difficulty accompanying the conventional device is that the temperature history of a central portion of the metal web is different from that of an edge portion. It is therefore impossible to obtain uniform induction heating of the web in the widthwise direction.

Figure 3:
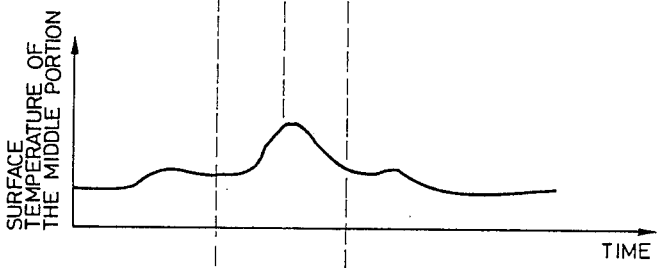
FIG. 3 is a graphical representation showing the surface temperature history of the middle portion of a metal web in the conventional method.
Figure 4:
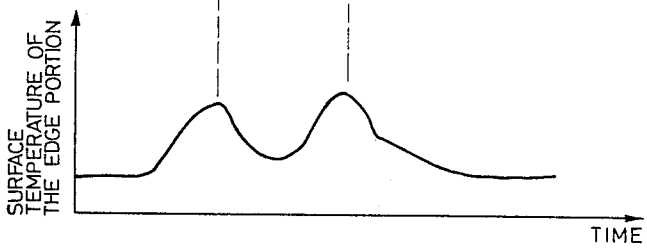
FIG. 4 is a graphical representation showing the surface temperature history of the edge portion of the metal web in the conventional method.

Because of this, in the case where induction heating is utilized during chemical treatment of a metal web, the middle portion of the web is made different from the edge portion in its chemical reaction pattern and in chemical reaction quantity (the reaction speed generally increases with increasing temperature), with the result that the web thus treated is irregular in roughness. FIG. 3 is a graphical representation indicating the surface temperature history of the middle portion 8 of metal web of FIG. 2, and FIG. 4 is a graphical representation indicating the surface temperature history of the edge portion 9. These figures clearly show the problem of temperature history accompanying the conventional device.

Intensive research on these problems has resulted in the following method: a three-phase AC power source is used so that the magnetic field generated by the inductor is shifted continually whereby the induction current ring on the metal web is moved on the plate at high speed. The induction current ring, which is the heat generating ring, moves at high speed; that is, its speed relative to the metal web is increased, which averages the heating and cooling cycles.

This process will be described hereinafter in more detail.

Figure 5:
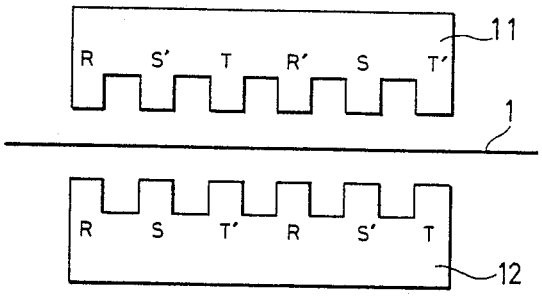
FIG. 5 is an explanatory diagram showing a cross magnetic field type induction heating method according to this invention.
Figure 6:
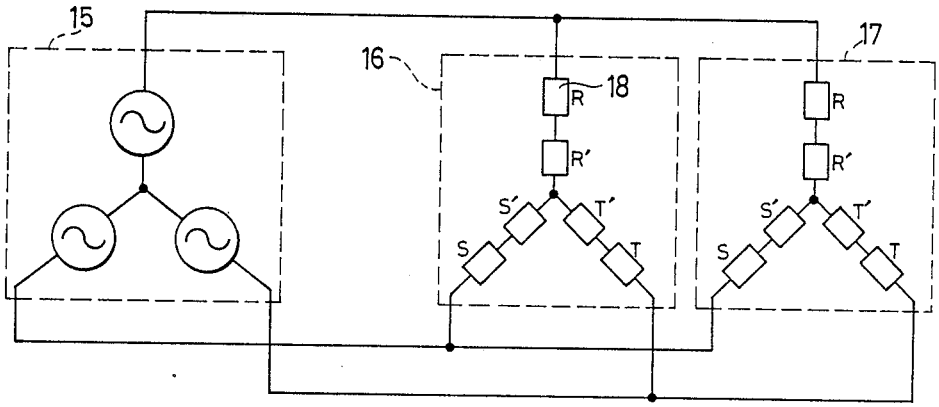
FIG. 6 is a circuit diagram showing one example of the electrical connection of an induction heating power source in the invention.

FIG. 5 shows an example of an induction heating device according to the invention. The inductor has poles arranged as shown in FIG. 5; that is, it has a 3-phase 6-pole arrangement in which forward windings and reverse windings occur alternately. The R-phases, S-phases and T-phases and connected to the respective phases of the three-phase AC power source. FIG. 6 shows one example of the connection of the induction heating device of the invention to the power source. In FIG. 6, the windings R' are opposite in winding direction to the windings R, and so forth.

In the above-described induction heating device, the phases of the inductor are connected to the power source as described above; however, it should be noted that the invention is not limited thereto or thereby. That is, the same effect can be obtained by connecting them according to other methods.

Figure 7:
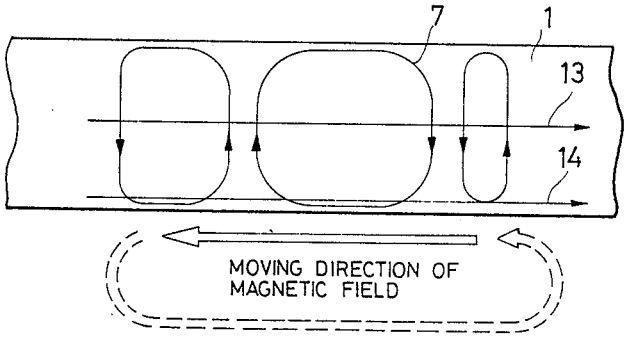
FIG. 7 is a diagram showing an induction current distribution on a metal web in the invention.

FIG. 7 shows the induction current distribution on the metal web at a certain time instant; Joule heat is generated at the induction current rings. Because of the movable magnetic field, the induction current ring is cyclically moved along the metal web as shown in FIG. 7; that is, the belt part heated by the induction current is also cyclically moved along the metal web.

Thus, the heated and cooled parts are moved along the metal web. Therefore, the temperature history pattern is considerably small in period; that is, the temperature history is averaged. Accordingly, in the invention, the inductor can be considered as a simple heating plate and the web is effectively continuously heated.

Figure 8:
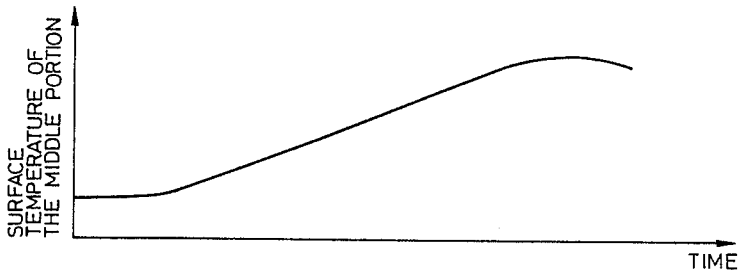
FIG. 8 is a graphical representation showing the surface temperature history of the middle portion of a metal web in the invention.
Figure 9:
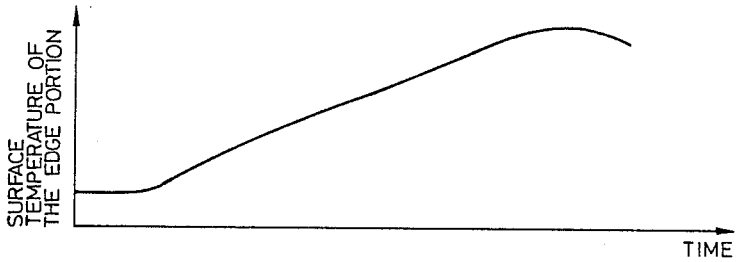
FIG. 9 is a graphical representation showing the surface temperature history of the edge portion of the metal web in the invention.

FIG. 8 is a graphical representation indicating the surface temperature history of the middle portion 13 of the metal web of FIG. 7, and FIG. 9 is a graphical representation indicating the surface temperature history of the edge portion.

As is apparent from FIGS. 8 and 9, the metal web is not cyclically heated and cooled; instead, it is simply heated. If, in practicing the method of the invention, a metal web is induction-heated using power corresponding to the amount of heat radiated from the surface, the web can be held uniformly at a given temperature.

The invention is applicable to processes which chemically or electro-chemically treat a metal web, or other processes such as that of drying a metal web which has been coated with paint. The invention can eliminate the difficulty accompanying the conventional method where the temperature history lowers the quality of the product; that is, the invention can realize induction heating without creating a temperature history effect.

With the above-described magnetic field type induction heating device, the metal web is not cyclically heated or cooled; instead, it is simply heated. Therefore the temperature of the web can be held constant during treatment. That is, according to the invention, the web can be induction-heated with no temperature history, which eliminates the difficulty of the conventional method where the temperature history lowers the quality of the product.

A photo-sensitive layer is formed on the aluminum support thus treated, and is then subjected to exposure and development to form a printing plate. With the printing plate set on the printing machine, the printing operation is started.

Figure 10:
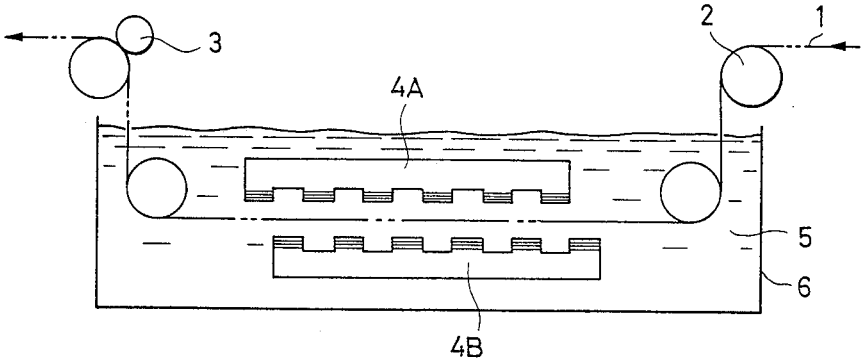
FIG. 10 is an explanatory diagram showing an apparatus for practicing chemical treatment according to the invention.

The invention will be described with reference to the case where a metal web is subjected to chemical treatment. In FIG. 10, reference numeral 1 designates a metal web; 2, pass rollers for conveying the web 1; and 3, a solution dripping nip roller for preventing the movement of the web treating solution to the following station. Further in FIG. 10, reference characters 4A and 4B designate an induction heating device for heating the web 1. In the induction heating device, alternating current is applied to the coils would on the magnetic poles so that alternating magnetic fields are generated by the magnetic poles. Therefore, when the metal web 1 is placed in the alternating magnetic fields thus generated, electro-magnetic induction occurs with the metal web 1 so that eddy currents flow in the metal web 1 to generate Joule heat therein to thereby heat the metal web 1. In FIG. 10, reference numeral 5 designates the aforementioned web treating solution; and 6, a web treating tank.

The invention will be described in more detail with reference to several examples; however, it should be noted that the invention is not limited thereto or thereby.

EXAMPLE 1

An aluminum web whose surface was mechanically roughened was subjected to chemical treatment. The aluminum web thus mechanically surface-roughened was 0.6 μm in average surface roughness, and a number of protrusions ("burrs") could be observed on the surface under the microscope. With the aluminum web immersed in a 10% caustic soda solution at a temperature of 25° C., a current of 120A was applied to the induction-heating coils for thirty seconds so that the temperature of the aluminum web was raised to 70°. The aluminum web thus treated was washed, and immersed in a 30% nitric acid solution at a temperature of 30° C. for ninety (90) seconds for neutralization, and then washed again. The aluminum web thus treated was 0.55 μm in average surface roughness, and no protrusions were observed on the surface under the microscope. Although chemical treatment was carried out continuously for eighty (80) hours, no scale was formed in the web treating tank.

COMPARISON EXAMPLE 1

An aluminum web mechanically surface-roughened similarly as in Example 1 was immersed in a 10% caustic soda solution at 70° C. for thirty (30) seconds, and then washed. The aluminum web thus treated was immersed in a 30% nitric acid solution at 30° C. for 90 sec. for neutralization, and then again washed. The aluminum web thus treated was 0.55 μm in surface roughness and has no protrusions in the case of Example 1. However, after chemical treatment was carried out continuously for eighty (80) hours, scales could be found in the web treating tank, and problems attributable to scale occurred.

EXAMPLE 2

An aluminum web was immersed in a 10% caustic soda solution at 70° C. for thirty (30) seconds and then washed. The aluminum web thus treated was immersed in a 30% nitric acid solution for ninety (90) seconds for neutrilization, and then again washed. The aluminum web thus treated was held in a 0.7% nitric acid solution at 20° C. and was heated to 60° C. with a current of 100 A applied to the induction heating coils. The electrolytic conditions were $V_A = 12.7$ volts, $V_C = 9.1$ volts, and the quantity of anodizing electricity = 700 c/dm$^2$. The aluminum web thus treated was 0.52 μm in average surface roughness, and was uniform in surface roughness. The aluminum web thus held was electro-chemically surface-roughened with the current waveform described in the specification of Japanese patent application Publication No. 19191/1980. Even after the chemical treatment was carried out continuously for eighty (80) hours, no scale was formed in the nitric acid solution tank.

EXAMPLE 3

An aluminum web was immersed in a 10% caustic soda solution at 20° C. with a current of 120 A applied to the induction heating coils so that the aluminum web was heated to 70° C., and then washed. The aluminum web thus treated was immersed in a 30% nitric acid solution at 30° for ninety seconds for neutralization, and then again washed. The aluminum web thus treated was held in a 0.7% nitric acid solution at 20° C. and was heated to 60° C. with a current of 100 A applied to the induction heating coils. The aluminum web thus held was electro-chemically surface-roughened with the electric current having waveform described in the specification of Japanese patent application Publication No. 19191/1980. the electrolytic conditions were $V_A = 12.7$ volts, $V_C = 9.1$ volts, and the quantity of anodizing electricity = 700 c/dm$^2$. The aluminum web thus surface-roughened was 0.52 μm in average surface roughness, and was uniform in surface roughness. Even after the chemical treatment was carried out continuously for eighty (80) hours, no scale was formed in the nitric acid solution tank.

COMPARISON EXAMPLE 2

An aluminum web was treated in the same manner as in Examples 2 and 3; however, in this case, induction heating was not employed, and the temperatures of the caustic soda solution and the nitric acid solution were set to 70° C. and 60° C., respectively. After about ten hours, scales were formed in the tank, and associated scale problems frequently occurred.

As is apparent from the above description, the metal sheet or web is induction-heated, with the result that the reaction speed is increased. In this operation, it is unnecessary to increase the temperature of the web treating solution. Accordingly, no scales are formed in the web treating tank, and the materials are prevented from corrosion.

Furthermore, in the method of the invention, the temperature of the metal sheet or web can be readily changed. Therefore, when the treatment conditions are to change, subsequent metal sheets or webs can be chemically treated in a period of time shorter than required for changing the treatment solution temperatures.

What is claimed is:

1. A method of manufacturing supports for a lithographic printing plate comprising;

chemically treating a metal sheet or web in a treatment solution, and heating said sheet or web by an induction heating method while said sheet or web is in said treating solution.

2. A method as claimed in claim 1, wherein said induction heating method comprises a cross magnetic field type induction heating method.

3. A method as claimed in claim 2, wherein said cross magnetic field type induction heating method is achieved by the continuous movement of magnetic fields.

4. A method as claimed in claim 3, wherein a three-phase AC power source is employed in the formation of said movable magnetic fields.

5. A method as claimed in claim 3, wherein the direction of movement of said magnetic fields is the same as or opposite to the direction of movement of the metal sheet or web.

6. A method as claimed in claim 1, wherein said metal sheet or web is heated without substantially varying the temperature of said treatment solution as a whole.

7. A method as claimed in claim 1, wherein said step of chemically treating comprises chemically etching said sheet or web.

8. A method as claimed in claim 1, wherein said step of chemically treating varies a surface roughness of said sheet or web.

9. A method as claimed in claim 1, further comprising an initial step of mechanically roughening the surface of said metal sheet or web.

10. A method of manufacturing supports for a lithographic printing plate comprising;

electro-chemically treating a metal sheet or web in a treatment solution, and simultaneously heating said sheet or web by an induction heating method.

11. A method as claimed in claim 10, wherein said induction heating method comprises a cross magnetic field type induction heating method.

12. A method as claimed in claim 10, wherein said cross magnetic field type induction heating method is achieved by the continuous movement of magnetic fields.

13. A method as claimed in claim 10, wherein a three-phase AC power source is employed in the formation of said movable magnetic fields.

14. A method as claimed in claim 10, in which the direction or movement of said magnetic fields is the same as or opposite to the direction of movement of the metal sheet or web.

15. A method as claimed in claim 10, wherein said metal sheet or web is heated without substantially varying the temperature of said treatment solution as a whole.

16. A method as claimed in claim 10, wherein said step of electro-chemically treating comprises a sheet or web surface roughening method.

17. A method as claimed in claim 10, further comprising the initial step of mechanically roughening the surface of said metal sheet or web.

18. A method as claimed in claim 10, further comprising the initial steps of mechanically roughening said metal sheet or web, followed by chemically treating said sheet or web.

19. A method as claimed in claim 1, further comprising the step of forming an anodic oxide film on said metal sheet or web.

20. A method as claimed in claim 1, further comprising the step of forming a base film on said metal sheet or web, followed by forming an anodic oxide film on said base film.

21. A method as claimed in claim 20, wherein said base film is an alkali metal silicate film.

22. A method as claimed in claim 20, wherein said base film is a hydrophilic undercoat film.

23. A method as claimed in claim 20, further comprising the step of forming a photosensitive layer on said anodic oxide film.

24. A method as claimed in claim 1, further comprising the steps of electro-chemically treating said metal sheet or web subsequent to said step of chemical treatment, and heating said sheet or web by an induction heating method during said electro-chemical treatment.

* * * * *